United States Patent [19]

Yamaguchi

[11] Patent Number: 4,718,313

[45] Date of Patent: Jan. 12, 1988

[54] HAMMER HEAD FOR A HAMMER

[76] Inventor: Toshihiko Yamaguchi, 4-1, Uenoshibacho 4 cho, Sakai-shi, Osaka 593, Japan

[21] Appl. No.: 909,195

[22] Filed: Sep. 19, 1986

[30] Foreign Application Priority Data

Mar. 25, 1986 [JP] Japan ..... 61-44348[U]

[51] Int. Cl.[4] ..... B25D 1/00

[52] U.S. Cl. ..... 81/23; 81/452

[58] Field of Search ..... 81/23, 44, 451, 452, 81/456

[56] References Cited

U.S. PATENT DOCUMENTS 951,646 3/1910 Lambert ..... 81/23

1,143,277 6/1915 Hulse ..... 81/23

FOREIGN PATENT DOCUMENTS 552630 12/1956 Italy ..... 81/23

OTHER PUBLICATIONS

"Latthammer", from a catalogue of Carl Dan. Peddinghaus, Gmblt & Co. Kommanditgesellschaft, Postfach 3073.5828 Ennepetal 13.

"NWS Nagel-Magnet", from a catalogue of Napeln & Schrauben.

*Primary Examiner*—Frederick R. Schmidt

*Assistant Examiner*—Judy J. Hartman

*Attorney, Agent, or Firm*—Wenderoth, Lind & Ponack

[57] ABSTRACT

A hammer head for a hammer which includes a nail-holding part which allows a nail to be initially driven in a wall by a worker using only one hand. The nail-holding part includes a striking surface which engages the head of a nail and a pair of pinching pieces which engage opposite sides of the shank of the nail therebetween. The pair of pinching pieces permit nails of various diameters to be held therebetween and the pair of pinching pieces are disposed adjacent to the striking wall for tightly holding the nail with the head of the nail in tight engagement with the striking wall. A groove is provided in the hammer head at a location further from the striking wall than the pinching pieces for supporting the shank of the nail. The nail-holding part is disposed within a recess in the hammer head and does not interfere with the normal operation of the hammer head.

20 Claims, 7 Drawing Figures

HAMMER HEAD FOR A HAMMER

BACKGROUND OF THE INVENTION

1. Field of the Invention

The present invention relates to a hammer which is provided with a part in the hammer head for holding one end of a nail such that the nail can be preliminarily driven part way into a surface by striking the surface with the nail held by the hammer head. Thus, the present invention allows a worker to start a nail in a surface while using only one hand.

2. Description of the Prior Art

In the fields of building and construction, it is sometimes necessary for workers to use a hammer under conditions in which only one hand is free to swing the hammer and set a nail in place. For instance, a worker may need the support of one hand when working in high places, areas having poor footing, etc. or a worker may need to use a hammer in areas which are not large enough to use both hands for setting a nail in place and swinging the hammer such as in areas which are very low or narrow. As such, hammers have been developed which have magnetic parts for holding a nail at the head of a hammer so that the nail can be started or set prior to being driven into a surface. These types of hammers are difficult to operate since the nail is held at only the small region of the head thereof.

The known hammer having a magnetic member for holding a nail does not provide enough of a fastening force to hold the nail since the nail is only held at its head portion and when the nail is oriented to strike a surface, the effect of gravity on the long extending front part of the nail has a tendency to overcome the magnetic force holding the head of the nail to the hammer with the result that the nail falls off of the hammer head. Also, when the hammer is swung with a nail held magnetically on the hammer head there is a tendency for the centrifugal force acting on the nail to overcome the magnetic force holding the nail to the hammer head with the result that the nail is not driven in a desired direction or falls off of the hammer head.

It is an object of the present invention to provide a hammer which overcomes the difficulties mentioned above.

SUMMARY OF THE INVENTION

The present invention overcomes the difficulties with the prior art hammers by providing a means on the hammer head for supporting the shaft of a nail with the head of the nail fitted against a striking wall of the hammer head. Thus, the hammer of the present invention allows a nail to be securely held in place on the hammer head so that it can be accurately driven into a surface while a worker uses only one hand.

BRIEF DESCRIPTION OF THE DRAWINGS

The present invention will be described with reference to the accompanying drawings, in which.

DETAILED DESCRIPTION OF THE PREFERRED EMBODIMENT

The hammer of the present invention comprises a hammer head having a nail-striking part which consists of a striking wall and a nail-holding part, the nail-holding part made up of a pair of pinching pieces disposed adjacent to the striking wall, the pinching pieces being elastically yieldable for receiving the shaft of a nail between them. The pair of pinching pieces may be elastically deformed away from each other to receive nails having various diameters. Since the pair of pinching pieces are located adjacent a striking wall, the nail-holding part of the present invention can be used to fixedly hold various sized nails on the head of a hammer so that they can be preliminarily struck into a surface. Also, a nail which has been preliminarily struck with the nail-holding part can be easily wrenched from the pair of pinching pieces to thus separate the nail from the head of the hammer.

Figure 1:
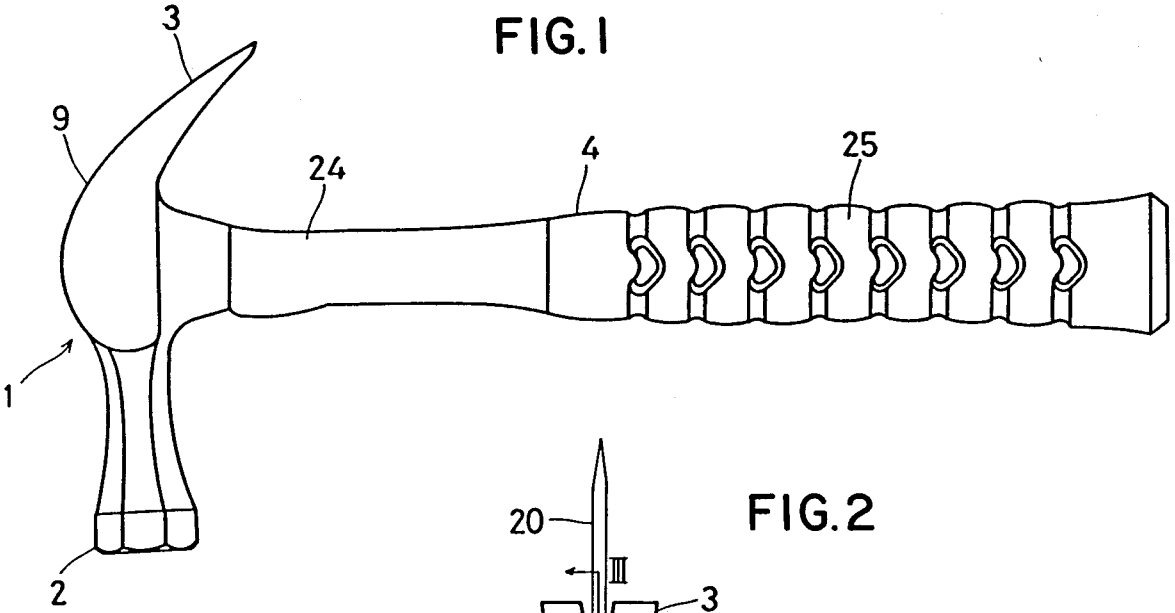
FIG. 1 is a perspective side view of the hammer of the present invention.
Figure 3:
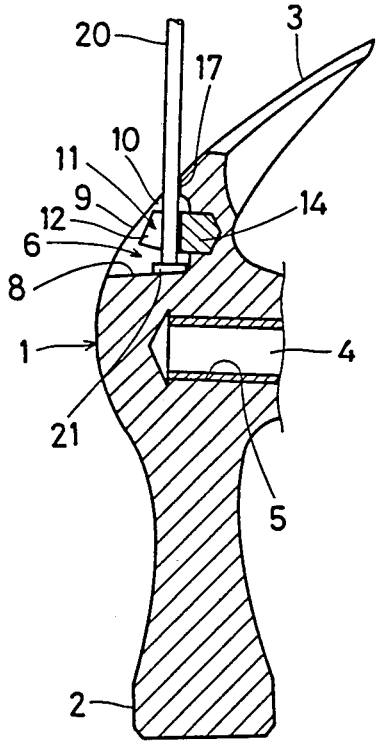
FIG. 3 is a cut-away view taken along the line III—III shown in FIG. 2.

As shown in FIG. 1, a head 1 of a metallic hammer includes a nail-striking part 2 having a flat surface at one end of the head and a forked arcuate shaped claw 3 on the other end thereof. The hammer head 1 includes a helve-fitting opening 5 which is provided between the nail-striking part 2 and the claw 3 with the core of a helve 4 of the hammer rigidly secured into the opening 5 by means such as an adhesive or other attachment means. A nail-striking part 6 is formed at the head of the hammer 1 as shown in FIG. 3. The nail-striking part 6 includes a nail-holding part 11 and a striking wall 8.

The striking wall 8 can be formed by providing a recess 10 in a portion of the hammer head 1 located between a center portion of the nail head 1 and the claw 3. The recess 10 extends inwardly from and between laterally spaced-apart sidewalls of the convex arcuate-shaped surface 9 which forms the surface engaging part on the opposite side of the nail pulling part of the claw 3. As shown in FIG. 3, the striking wall 8 is substantially parallel to the longitudinal direction of the helve 4 of the hammer and provides a support surface for engaging a nail head such that the shank or trunk part 20 of the nail extends substantially perpendicularly from the striking wall 8. A nail-holding part 11 is disposed on a surface of the recess 10 which is substantially perpendicular to the striking wall 8, the nail-holding part 11 being spaced a small distance from the striking wall 8.

Figure 4:
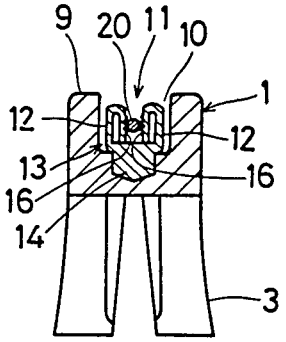
FIG. 4 is a cut-away view taken along the line IV—IV shown in FIG. 2.
Figure 5A:
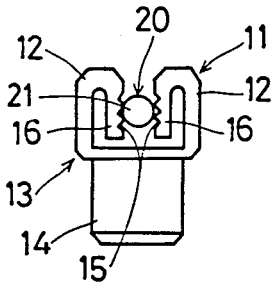
FIGS. 5*a–c* show the nail-holding part of the present invention when used with nails having different diameters.
Figure 5B:
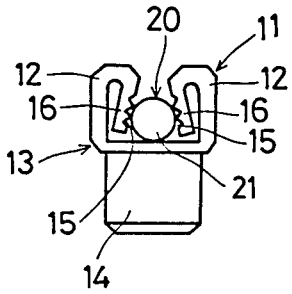
Figure 5C:
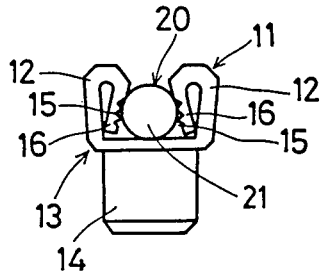

The nail-holding part 11 is made of plastic such as polyurethane, metal, or other material having an elastic property. The nail-holding part 11 is U-shaped in cross section and includes a main body part 13 which is formed integrally with a pair of pinching pieces 12 and a base part 14. The pinching pieces 12 are spaced a small distance apart on one side of the main body 13 and the base part 14 extends from the opposite side of the main body part 13. A bore is provided in the hammer head 1 for receiving the base part 14 of the nail-holding part 11, the base part 14 being embedded in the bore and may be secured thereto by means of an adhesive or other attaching means. The pinching pieces 12 are each formed from a flat piece of material in an inverted U-shape with one leg of the U-shaped portion thereof integral with the main body 13 and the other leg of the U-shaped portion being elastically movable with respect to the main body 13. Thus, as shown in FIG. 4, the inner leg portions of the pinching pieces 12 are movable towards and away from each other for holding the shank or trunk part of a nail 20 therebetween. The inner leg portions of the pinching pieces 12 thus form a pair of flat elastic pieces 16 each of which is provided with a plurality of parallel grooves 15 which extend in a direction substantially perpendicular to the striking wall 8 for preventing the shank of a nail from sliding out of engagement with the elastic pieces 16. As shown in FIGS. 5*a–c*, the grooves 15 extend in a direction which is parallel to the shank of a nail. The provision of the grooves 15 also contributes to the elasticity of the elastic pieces 16.

A groove 17 which extends in a direction perpendicular to the striking wall 8 is provided between the recessed part 10 and the convex arcuate-shaped surface 9, as shown in FIG. 3. The groove 17 is provided for supporting the trunk part of a nail at a position along the nail located further from the nail head than the location of the pinching pieces 12. The combination of the groove 17 with the pinching pieces 12 and the nail striking wall 8 effectively holds a nail in position for being preliminarily driven into a surface which can be performed by a worker using only one hand.

Figure 2:
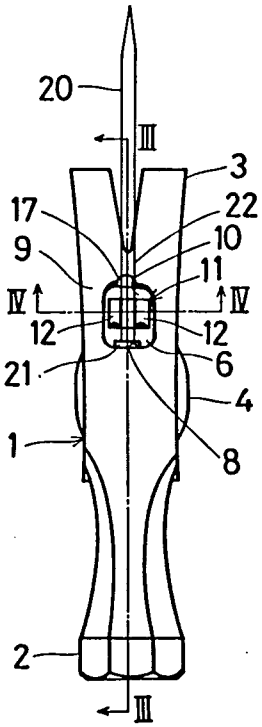
FIG. 2 is a perspective end view of the hammer head shown in FIG. 1.

As shown in FIGS. 2 and 3, the hammer of the present invention having a nail-striking part 6 holds a nail 20 by pinching the sides of a shank or trunk part 22 thereof at a position relatively near the nail head 21 since a portion of the shank 22 is held between the elastic pieces 16 with another part of the shank 22 received in the groove 17 and the nail head 21 abutted against the striking wall 8. Thus, the nail 20 is held in such a manner that it can be easily driven into a surface by simply swinging the hammer toward the surface into which the nail is to be driven. Due to the elastic nature of the pinching pieces 12 it is possible to hold nails of various diameters. In the case of a nail having a relatively small diameter, the elastic pieces 16 are deformed a relatively small amount as shown in FIG. 5*a*. As the diameter of the nail becomes larger, the elastic pieces 16 as well as the remaining portion of the pinching pieces 12 are elastically deformed to accommodate the shank of the nail as shown in FIG. 5*a*. Furthermore, with relatively large diameter nails, the pinching pieces 12 are elastically deformed away from each other as shown in FIG. 5*c*. It should be clear from the above description that the pinching pieces 12 maintain a reliable pinching force on the shank 22 of a nail 20 no matter how large or small the diameter of the nail may be.

It can be seen from FIG. 3 that the striking part 6 does not extend outwardly from the convex arcuately-shaped surface 9 forming the surface engaging portion of the claw 3 and thus does not interfere with a nail pulling operation in which the nail head 21 of a nail 20 is received on the oppositely extending concaved arcuately-shaped surface of the claw 3. Also, the provision of the nail-holding part 11 in the recess 10 of the hammer head 1 protects the nail-holding part during use of the hammer for driving nails or striking objects with the nail-striking part 2.

The remainder of the hammer of the present invention comprises a cover 24 of synthetic resin having a relatively high degree of hardness surrounding a metalic pipe which forms the core of the helve 4, the cover 24 being provided adjacent the head of the hammer. Also, a grip 25 of gummy elastic material is provided around the metalic pipe forming the core of the helve 4 at the rearmost portion thereof.

The hammer of the present invention allows a worker to perform a nail setting and driving operation safely with one hand, especially when the worker is working under dangerous conditions or areas of limited space. A nail can be easily started with the hammer head of the present invention since the nail is gripped at four places, that is at the nail head 21 where it engages the striking wall 8, on either side of the nail where it engages the elastic pieces 16 and at a portion of the nail where it engages the groove 17. The synergistic effect of these four points of contact allows the nail to be firmly held on the head of the hammer no matter how the hammer head is oriented and there is less chance for the nail to be deflected upon striking a surface since the nail is securely held within the recess portion 10 of the hammer head 1. The provision of the pair of pinching pieces allows the nail to be held with the head portion 21 of the nail in tight contact with the nail striking surface 8. Furthermore, once the nail has been partly driven into a surface the elastic pinching pieces 12 allow the nail to be easily withdrawn from the nail-holding part 11 by pulling the hammer in a direction parallel to the longitudinal direction of the helve 4. Also, by rotating the hammer such that the claw 3 is brought closer to the shank 22 of the nail, the groove 17 acts as a fulcrum to pivot the shank portion 22 out of engagement with the pinching pieces 12. Thus, once a nail has been started with the nail-striking part 6 of the present invention, the nail can be readily removed from the nail-striking part 6.

I claim:

1. A hammer head for a hammer which comprises a nail driving part at one end of the hammer head and a claw at the other end of the hammer head, the hammer head including a nail-holding part, the nail-holding part including a striking wall formed in the hammer head and a pair of pinching pieces disposed adjacent to the striking wall, the pinching pieces being elastically deformable for receiving the shank of a nail therebetween with the head of the nail abutted against the striking wall, said striking wall being formed by one surface of a recess formed in said hammer head, said recess being formed along the between laterally spaced-apart sidewalls of a covex arcuately-shaped surface of said hammer head which extends from a central portion thereof and which forms a surface engaging part of the claw, said pair of pinching pieces being disposed within said recess, said pair of pinching pieces comprising elastic pieces which are deformable towards and away from each other, said elastic pieces being formed integrally with a base portion extending between said elastic pieces, said base portion being fitted in a bore disposed in a wall of said recess which is perpendicular to said striking wall.

2. The hammer head of claim 1, wherein said pair of pinching pieces are formed integrally with a base portion extending between said pinching pieces, each of said pinching pieces comprising a U-shaped part, one leg of the U-shaped part extending from said base portion and the other leg of said U-shaped part having a free end disposed above said base portion, the leg portions having the free ends thereon being spaced inwardly of the leg portions which are integral with the base portion.

3. The hammer head of claim 1, wherein said pair of pinching pieces are formed integrally with a base portion extending between said pinching pieces, each of said pinching pieces comprising a U-shaped part, one leg of the U-shaped part extending from said base portion and the other leg of said U-shaped part having a free end disposed above said base portion, the leg portions having the free ends thereon being spaced inwardly of the leg portions which are integral with the base portion.

4. The hammer head of claim 1, wherein a helve which extends in a longitudinal direction is fixedly secured to the hammer head, the striking wall of the nail-holding part being parallel to said longitudinal direction.

5. The hammer head of claim 1, wherein a groove is disposed on said hammer head between a central portion of said hammer head and said claw with said groove extending substantially perpendicularly to said striking wall, said pair of pinching pieces being disposed between said striking wall and said groove whereby a nail can be fitted in the nail-holding part with the nail head fitted against the striking wall and the shank of the nail being received with a part thereof between the pair of pinching pieces and another part thereof engaging with said groove.

6. The hammer head of claim 2, wherein grooves are provided on said leg portions having free ends thereon, said notched grooves extending substantially perpendicularly to said striking wall.

7. The hammer head of claim 3, wherein grooves are provided on said leg portions having free ends thereon, said grooves extending substantially perpendicularly to said striking wall.

8. The hammer head of claim 1, wherein said pair of pinching pieces comprise flat strips having an inverted U-shape on either side of a base portion with the outer leg portions of each inverted U-shaped flat strip being fixed to said base portion and the inner leg portions thereof having free ends spaced from said base portion, whereby said inner leg portions are elastically deformable towards and away from each other.

9. The hammer head of claim 8, wherein said inner leg portions include a plurality of parallel grooves thereon on surfaces of said inner leg portions facing each other, said grooves extending in a direction which is substantially perpendicular to said striking wall.

10. The hammer head of claim 9, wherein a groove extending substantially perpendicularly to said striking wall is disposed on the convex arcuate-shaped surface of said hammer head between a central portion thereof and a free end of said claw, whereby a nail can be supported at four points thereof with the head of the nail abutting said striking wall, the sides of the shank of the nail engaging said inner leg portions of said pinching pieces and another part of the shank of the nail engaging said groove.

11. A hammer head for a hammer which comprises a nail driving part at one end of the hammer head and a claw at the other end of the hammer head, the hammer head including a nail-holding part, the nail-holding part including a striking wall formed in the hammer head and a pair of pinching pieces disposed adjacent to the striking wall, the pinching pieces being elastically deformable for receiving the shank of a nail therebetween with the head of the nail abutted against the striking wall, said striking wall being formed by one surface of a recess formed in said hammer head, said recess being formed along a convex arcuately-shaped surface of said hammer head which extends from a central portion thereof and which forms a surface engaging part of the claw, said pair of pinching pieces being disposed within said recess, said pair of pinching pieces being formed integrally with a base portion extending between said pinching pieces, each of said pinching pieces comprising a U-shaped part, one leg of the U-shaped part extending from said base portion and the other leg of said U-shaped part having a free end disposed above said base portion, the leg portions having the free ends thereon being spaced inwardly of the leg portions which are integral with the base portion.

12. The hammer head of claim 11, wherein a helve which extends in a longitudinal direction is fixedly secured to the hammer head, the striking wall of the nail-holding part being parallel to said longitudinal direction.

13. The hammer head of claim 11, wherein a groove is disposed on said hammer head between a central portion of said hammer head and said claw with said groove extending substantially perpendicularly to said striking wall, said pair of pinching pieces being disposed between said striking wall and said groove whereby a nail can be fitted in the nail-holding part with the nail head fitted against the striking wall and the shank of the nail being received with a part thereof between the pair of pinching pieces and another part thereof engaging with said groove.

14. The hammer head of claim 11, wherein grooves are provided on said leg portions having free ends thereon, said grooves extending substantially perpendicularly to said striking wall.

15. The hammer head of claim 11, wherein said pair of pinching pieces comprise flat strips having an inverted U-shape on either side of said base portion.

16. The hammer head of claim 15, wherein said inner leg portions include a plurality of parallel grooves thereon on surfaces of said inner leg portions facing each other, said grooves extending in a direction which is substantially perpendicular to said striking wall.

17. The hammer head of claim 16, wherein a groove extending substantially perpendicularly to said striking wall is disposed on the convex arcuate-shaped surface of said hammer head between a central portion thereof and a free end of said claw, whereby a nail can be supported at four points thereof with the head of the nail abutting said striking wall, the sides of the shank of the nail engaging said inner leg portions of said pinching pieces and another part of the shank of the nail engaging said groove.

18. A hammer head for a hammer which comprises a nail driving part at one end of the hammer head and a claw at the other end of the hammer head, the hammer head including a nail-holding part, the nail-holding part including a striking wall formed in the hammer head and a pair of pinching pieces disposed adjacent to the striking wall, the pinching pieces being elastically deformable for receiving the shank of a nail therebetween with the head of the nail abutted against the striking wall, said striking wall being formed by one surface of a recess formed in said hammer head, said recess being formed along a convex arcuately-shaped surface of said hammer head which extends from a central portion thereof and which forms a surface engaging part of the claw, said pair of pinching pieces being disposed within said recess, said pair of pinching pieces comprising flat strips having an inverted U-shape on either side of a base portion with outer leg portions of each inverted U-shaped flat strip being integral with said base portion and inner leg portions thereof having free ends spaced above said base portion, whereby said inner leg portions are elastically deformable towards and away from each other.

19. The hammer head of claim 18, wherein said inner leg portions include a plurality of parallel grooves thereon on surfaces of said inner leg portions facing each other, said grooves extending in a direction which is substantially perpendicular to said striking wall.

20. The hammer head of claim 19, wherein a groove extending substantially perpendicularly to said striking wall is disposed on the convex arcuate-shaped surface said hammer head between a central portion thereof and a free end of said claw, whereby a nail can be supported at four points thereof with the head of the nail abutting said striking wall, the sides of the shank of the nail engaging said inner leg portions of said pinching pieces and another part of the shank of the nail engaging said groove.

* * * * *